United States Patent [19]

Fierheller

[11] 4,170,084

[45] Oct. 9, 1979

[54] GLIDER TOY

[76] Inventor: Douglas E. Fierheller, R.R. #1, Maple, Ontario, Canada

[21] Appl. No.: 858,614

[22] Filed: Dec. 8, 1977

[30] Foreign Application Priority Data

Dec. 17, 1976 [CA] Canada ..... 268089

[51] Int. Cl.[2] ..... A63H 27/00

[52] U.S. Cl. ..... 46/79

[58] Field of Search ..... 46/76 R, 79-87

[56] References Cited

U.S. PATENT DOCUMENTS

| | | | |
|---|---|---|---|
| 865,419 | 9/1907 | Moorhead | 46/79 |
| 2,505,541 | 4/1950 | Guillow | 46/79 |
| 3,576,086 | 4/1971 | Halsey | 46/79 |

*Primary Examiner*—Russell R. Kinsey
*Assistant Examiner*—Robert F. Cutting
*Attorney, Agent, or Firm*—Zarley, McKee, Thomte, Voorhees & Sease

[57] ABSTRACT

This invention provides an improved version of a glider toy having a forwardly pointed triangular planar wing portion and a planar triangular body portion extending downwardly therefrom and having an adjustable weight movably attached to the lower edge of the body portion. The glider is preferably made of plastic and can be fabricated using extruded shapes which merely need to be trimmed to form the final structure.

2 Claims, 4 Drawing Figures

GLIDER TOY

This invention relates to improvements in glider toys of the type having a horizontal planar wing and a vertical planar body mounted thereon.

Toy gliders of this type have previously been made by folding rectangular sheets of paper so as to create a pointed "delta" shape or triangular wing portion tapered towards the forward end. While this "home-made" type of glider has been designed in a wide variety of shapes and sizes and dimensions, one of the most common types employs a simple triangular shape in which the wings are a flat horizontal isosceles triangle pointed at the forward end and tapered wider towards the tail end (sometimes known as the delta wing configuration). Similarly the body of this common type of glider toy typically forms a triangle disposed in a vertical plane depending from the underside of the wing along the middle line thereof and being tapered from the pointed forward end to a deeper tail end and having a length approximately coextensive with the wing portion.

This type of glider can for instance be formed by folding in the corners of a sheet of paper to make it narrow at the front end and then folding the paper in half along its longitudinal centre line, and then folding each half back in the opposite direction to form the two halves of the delta wings extending horizontally out from the downwardly projecting body portion. Modifications in the shape or proportion of the wings and body may be adapted to give the glider different flight characteristics.

Hitherto these toy gliders of the folded paper type, while they have the advantage of being readily produced by anyone with the basic knowledge of the art and a piece of paper, have had the disadvantage that they are generally fragile and flimsy, easily bent and torn, or inclined to get wet and become useless. Furthermore, the plane depends, to a certain extent, on the skill of the person making in in order to fly properly.

It is the purpose of this invention to provide a glider toy which can be readily manufactured inexpensively in large quantities, and which is more durable and reliable in the hands of its owner.

Accordingly, this invention provides a glider toy having a planar wing portion of generally triangular shape pointed forward and a planar body portion being likewise triangular and substantially coextensive with the wing portion mounted perpendicularly downward from the wing portion along its longitudinal centre line. To effect the desired flight characteristics an adjustable weight is provided which can be attached along the lower edge of the body portion by means of a U-shaped recess which will fit snugly with the lower edge of the body portion and allow the weight to be moved therealong but held in place by friction. The advantages of this invention are best achieved by a glider toy made of plastic, and in particular extruded plastic. Thus the invention lends itself to an improved method by which the glider toy can be fabricated first of all by extruding an "I-beam" shaped length of plastic which can be cut into appropriate lengths, cut diagonally along the web to form two triangular body portions and then by trimming the flanges to create the triangular wing portion. Similarly, the weight may be formed by extruding a length of plastic having a U-shaped recess adapted for snug fit with the lower edge of the body portion; the individual weights being provided by cutting short lengths of the extrusion.

The charachteristics and advantages of the design of the present invention would be more apparent in the following description with reference to the drawings in which.

Figure 1:
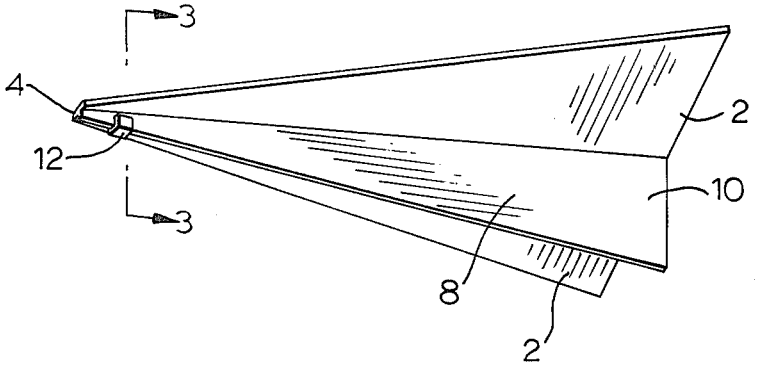
FIG. 1 is a perspective view of a glider toy made in accordance with this invention viewed from below.

FIG. 1 illustrates a glider toy in accordance with this invention having a wing portion 2 which is generally planar, horizontal (in the normal flying position) and has a triangular or "delta" shape pointed or narrowed at the forward end 4 and progressively wider towards the tail end 6. The body portion 8 is likewise triangular in shape having a small forward end at 4 and being tapered progressively deeper towards the rear edge 10.

The body portion is mounted to depend vertically downward from the bottom of the wing portion and is mounted along the longitudinal centre line thereof. The body portion illustrated is longitudinally coextensive with the length of the wing portion in FIG. 1 but this might be modified, if desired.

Figure 2:
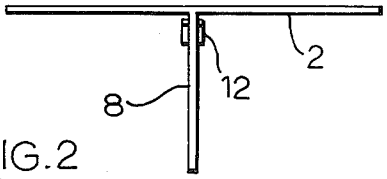
FIG. 2 is an elevation view from the rear of the embodiment as shown in FIG. 1.

FIG. 2 is a vertical elevation view from the rear of the embodiment in FIG. 1 and illustrates the position of the body portion 8 extending vertically downwards from the mid-line of the wing portion 2, perpendicular thereto.

Figure 3:
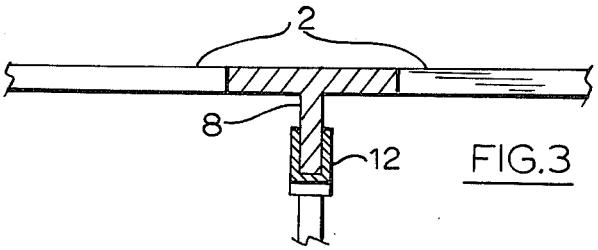
FIG. 3 is a vertical cross-section of the embodiment as shown in FIG. 1.

In order to adjust the flight characteristics of a glider toy of this nature, it is desirable to be able to adjust the weight distribution in the kite, or in other words, to change the centre of gravity forward or rearward as required. For this purpose there is an adjustable weight 12 illustrated in FIG. 1 and FIG. 3. This weight is a generally U-shaped member having a central recess 14 adapted to receive the lower edge of the body portion 8 in snug fit so as to provide an adjustable friction attachment of the weight as illustrated in FIG. 3. By virtue of the snug fit, the weight can be maintained in position but can be manually adjusted forward or rearward as required to effect the flight characteristics of the glider.

It is additionally conceived that a glider toy of this type could preferentially be made of plastic so as to overcome the inherent weeknesses of materials such as paper and cardboard or balsa wood which break, bend, tear or lose their strength on becoming wet. In addition the use of plastic for the adjustable weight 12 would be appropriate in order to provide an adjustable snug fit on the body portion of the glider.

A glider of this invention has an additional advantage in that it provides for easy and inexpensive manufacture in large quantities. For instance the wing portion and body portion of the glider may be formed together in plastic using the process of extrusion.

Figure 4:
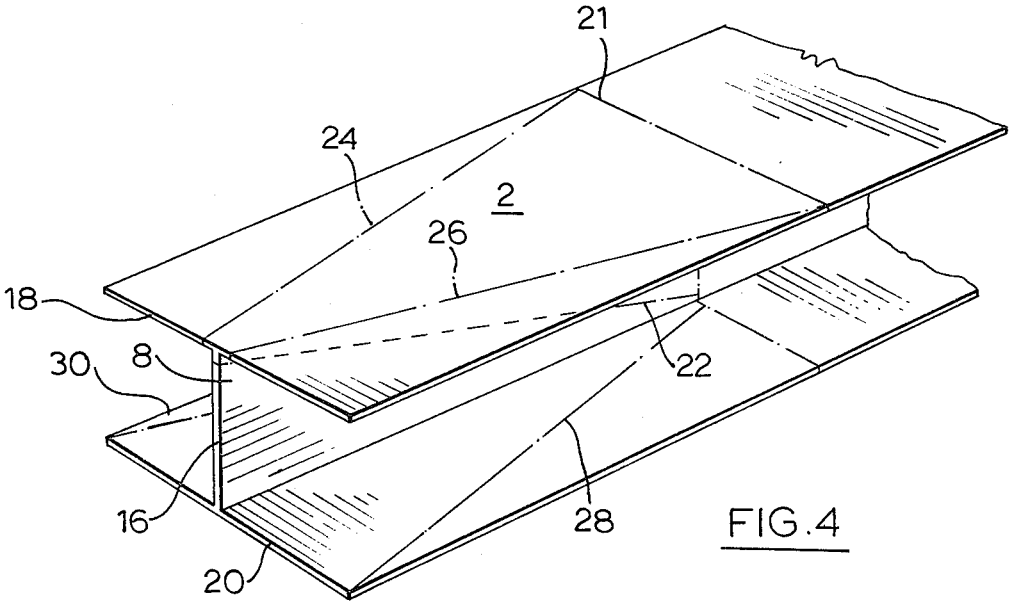
FIG. 4 is an illustration of a piece of material used in the manufacture of the embodiment of FIG. 1 in an intermediate stage in the manufacture.

FIG. 4 illustrates an extruded piece of plastic in the general shape of an "I-beam" having a web portion 16 and flanges 18 and 20 respectively, which is a shape that can easily be extruded in plastic. The extrusion can be cut to desirable lengths at line 21. By cutting the web along the diagonal line 22 and trimming the flanges along the lines 24, 26, 28 and 30 respectively, two glider toys are formed from a single length of the extruded material.

The toy can then be completed by the addition of a weight such as 12 which also can be made of short lenghts of extruded U-shaped plastic.

By cutting along lines such as 22, 24, 26, 28, and 30 which are spaced slightly from the juncture of the web and flange, the glider will be formed with a slightly blunted forward end which may be desirable as being safer and less fragile.

Thus by means of this invention a glider toy can be made which is of uniform design, is substantially durable and reliable, is simple and inexpensive to manufacture in large quantities.

It will be appreciated that minor variations in the structure or its manufacture might be adopted without departing from the inventive concept herein.

What I claim as new and desire to protect by Letters Patent of the United States is:

1. A method of forming a glider toy comprising the steps of:

extruding a long length of plastic in the shape of an "I-beam";

cutting said extrusion into desired lengths;

cutting said lengths diagonally along the web of said "I-beam" extrusion to form two triangular body portions;

trimming the flanges of said lengths to form triangular wing portions pointed in the same direction as the body portion.

2. A method as claimed in claim 1 including the steps of extruding a long length of U-shaped plastic having a recess adapted to receive the edge of said body portion snugly therein, and cutting said extrusion into short lengths to form a weight distribution member.

* * * * *